United States Patent [19]

Komamura et al.

[11] Patent Number: 4,770,989

[45] Date of Patent: Sep. 13, 1988

[54] HEAT-DEVELOPABLE COLOR PHOTOSENSITIVE ELEMENT

[75] Inventors: Tawara Komamura, Hachioji; Masaru Iwagaki, Hini; Takashi Sasaki, Hino; Fumio Ishii, Akishima; Kunihiro Koshizuka, Hino, all of Japan

[73] Assignee: Konishiroku Photo Industry Co., Ltd., Tokyo, Japan

[21] Appl. No.: 47,538

[22] Filed: May 4, 1987

Related U.S. Application Data

[63] Continuation of Ser. No. 834,647, Feb. 27, 1986, abandoned, which is a continuation of Ser. No. 616,941, Jun. 4, 1984, abandoned.

[30] Foreign Application Priority Data

Jun. 13, 1983 [JP] Japan ..... 58-104249

[51] Int. Cl.[4] ..... G03C 1/02; G03C 1/40

[52] U.S. Cl. ..... 430/553; 430/555; 430/557; 430/562; 430/203; 430/619; 430/620; 430/351

[58] Field of Search ..... 430/628, 618, 619, 620, 430/543, 552, 558, 203, 553, 555, 557

[56] References Cited

U.S. PATENT DOCUMENTS

| | | | |
|---|---|---|---|
| 3,438,776 | 4/1969 | Yudelson | 430/617 |
| 3,561,967 | 2/1971 | Sakai et al. | 430/628 |
| 3,713,829 | 1/1973 | Nishio et al. | 430/628 |
| 4,220,709 | 9/1980 | de Mauriac | 430/620 |
| 4,283,477 | 8/1981 | Fletcher et al. | 430/620 |
| 4,426,441 | 1/1984 | Adin et al. | 430/620 |
| 4,430,415 | 2/1984 | Aono et al. | 430/203 |

OTHER PUBLICATIONS

Research Disclosure, 17029, Jun. 1978.

*Primary Examiner*—Won H. Louie
*Attorney, Agent, or Firm*—Jordan B. Bierman

[57] ABSTRACT

A heat-developable color photosensitive element having a support bearing thereon at least one photographic component layer containing a photosensitive silver halide, an organic silver salt, a reducing agent, a dye donor substance and a binder. The photosensitive element is characterized by the photographic component layer which contains a thermal solvent and a binder which contains both a gelatin and a vinyl pyrrolidone polymer.

29 Claims, No Drawings

HEAT-DEVELOPABLE COLOR PHOTOSENSITIVE ELEMENT

This application is a continuation of application Ser. No. 834,647, filed Feb. 27, 1986, abandoned, which is a continuation of application Ser. No. 616,941, filed June 4, 1984, abandoned.

BACKGROUND OF THE INVENTION

1. Field of the Invention

This invention relates to a heat-developable color photosensitive element excellent in developability and in image-transferability and, more particularly, to a heat-developable color photosensitive element capable of preventing a color turbidity as well as maintaining a high color developing efficiency and suitable for producing a multicolor image because of its excellent dye-transferability.

2. Description of the Prior Art

Conventionally known color photographic processes having used photosensitive silver halides have been superior to the other color photographic processes, in photosensitivity, gradient, image-preservability and the like, and have therefore been most widely put in practical use. In these processes, however, there are numbers of problems such as that it takes time and trouble to process because wet-processes are applied to developing, bleaching, fixing and washing steps, for example, that fears are entertained that the human body would be hurt by processing chemicals, that there is a fear of contaminating a processing room and a working personnel by the processing chemicals, and that it takes trouble and cost to dispose of waste materials.

Accordingly, there is a demand for the developments of a color image forming method capable of using a dry process.

Heat-developable black-and-white photosensitive materials have been known since early times, which are characterized in that the materials and developed by heat. There are the descriptions thereof in, for example, Japanese Patent Examined Publication Nos. 4921/1968 and 4924/1968, in which the photosensitive materials comprising an organic acid silver salt, a silver halide and a developer are disclosed. In addition, quite a number of heat-developable color photosensitive materials have been known to which the described heat-developable black-and-white photosensitive materials have been applied.

There are the descriptions of the heat-developable photosensitive materials containing couplers for photographic use and color developing agents in, for example, U.S. Pat. Nos. 3,531,286, 3,761,270 and 3,764,328, and Research Disclosure Nos. 15108, 15127, 12044 and 16479, and the like; the descriptions of those using leuco dyes in U.S. Pat. No. 3,180,731 and Research Disclosure Nos. 13443 and 14347, and the like; the descriptions of those to which the silver dye bleaching processes are applied in U.S. Pat. No. 4,235,957, and Research Disclosure Nos. 14443, 14448, 15227, 15776, 18137 and 19419, and the like; and the description of the heat-bleaching processes for heat-developable photosensitive materials in U.S. Pat. Nos. 4,124,398, 4,124,387 and 4,123,273; respectively.

With those proposals relating to heat-developable color photosensitive materials, it is difficult or impossible at all, according to time and circumstances, to bleach or fix a black-and-white silver image formed simultaneously, and a wet-process is required to apply even if it should be possible to bleach or fix the image. Preferable merit is rarely to be found in those proposals because a sharp color image may hardly be obtained and a complicated after-treatment is required.

In the meantime, there are the disclosures of heat developable color photosensitive materials capable of transferring diffusible dyes having been released by a heat-development so as to obtain color images, in Japanese Patent Publication Open to Public Inspection (hereinafter referred to as Japanese Patent O.P.I. Publication) Nos. 179840/1982, 186744/1982, 198458/1982, 207250/1982, 40551/1983 and 58543/1983, and in addition, in Japanese Patent Application Nos. 122596/1982 and 229649/1982 which were applied by the present inventors. These proposals are that a dye-donor substance having diffusible dyes in one and the same molecule releases the diffusible dyes through the heat-developing reaction with an organic acid silver salt and dyes are transferred to the image-receiving layer of the photosensitive material so that a color image may be obtained. This type of the photosensitive materials is hereinafter called "Dye-releasing type".

In the meanwhile, the proposals made by the present inventors disclosed in Japanese Patent Application Nos. 229671/1982, 33363/1983 and 33364/1983 are that a colorless or light-colored dye-donor substance reacts with the oxidant of a color developing agent which is produced through the heat-developing reaction of an organic acid silver salt to form heat-diffusible dyes and the diffusible dyes are transferred imagewise onto an image-receiving layer so that a color image may be obtained. This type is hereinafter called "Dye-forming type".

Even in these dye-releasing type, dye-forming type and the like, however, the developability and/or image transferability thereof are unsatisfactory and, in particular, both of the developability and the image-transferability cannot be satisfied at the same time when a photosensitive material is double- or multi- layered so as to obtain a multicolored image. To be more concrete, a color turbidity will cause, a color developing efficiently (i.e., a color releasing or forming efficiency to a unit amount of silver) will be lowered, or the transferability of a dye from a lower layer to the upper one will be unsatisfactory. Therefore, they have not yet attanined the level of practical use.

There is a demand for the developments of such a heat-developable color photosensitive element as those capable of preventing color turbidity, having a high color-developing efficiency and a high image-transferability of dyes, and obtaining a high image-density, and suitable for obtaining a multicolor image.

After having continued a series of studies on the technical problems as described above, the facts have come to the knowlege of the inventors that the binders in the photographic constituent layer of a photosensitive element has not only a great influence on the coating properties of the layer and the dispersibility or unmobility of a color-dye doner substance and the like, but also a great control power over the developability and image transferability thereof.

However, in most of the photographic materials comprising the conventionally known heat-developable color photosensitive elements and image-receiving elements, a color turbidity and the problems caused in a color developing efficiency, a high-density image and the like have been tried to solve by a dye releasing or forming technique applicable to a photosensitive element comprising a dye doner substance or the like, or by a dye receiving technique applicable to an image-receiving layer of an image-receiving element. On the contrary, such attempts as tried to solve the problems by the binders of a photosensitive element are few. For instance, the aforegiven Japanese Patent O.P.I. Publication Nos. 179840/1982 and 186744/1982 disclose the dye-releasing type in which hydrophobic polymer binders are used as the binders for photosensitive elements; and the aforegiven Japanese Patent O.P.I. Publication No. 207250 discloses that either hydrohilic polymers or hydrophobic ones may be used and lists up a number of examples thereof. As the particularly preferred examples of the hydrophobic polymers, polyvinyl butyral, polyvinyl acetate, ethyl cellulose, polymethyl methacrylate, and cellulose acetate butylate, may be given.

Nevertheless, after tring various experiments by the inventions, it was found that, even if such concrete examples given as the particularly preferred hydrophobic polymers are used as a binder, it was difficult to satisfy at the same time both of the developability and the image-transferability by which a color turbidity is prevented with keeping a high color-developing efficiency and a dye is endowed with a high image-transferability.

OBJECTS OF THE INVENTION

Accordingly, it is an object of the invention to provide a heat-developable color photosensitive element capable of preventing a color turbidity with keeping a high color-developing efficiency, simultaneously capable of endowing dyes with a high image-transferability, and in particular capable of suitably using for obtaining a multiplicity of colors.

The other objects of the invention may become apparent from the descriptions hereunder.

DETAILED DESCRIPTION OF THE INVENTION

As the result of continuously concentrating upon the studies to attain the above mentioned objects, the inventors found that the objects can be attained with a heat-developable color photosensitive element comprising a support having thereon at least one photographic constituent layer containing a photosensitive silver halide, an organic silver salt, a reducing agent, a color dye donor substance, and a binder, wherein the photographic constituent layer contains a thermal solvent and, gelatin and vinyl pyrolidone polymer as the binder. In other words, the inventors found that the objects of the invention can be attained with a heat-developable color photosensitive element comprising a support having thereon at least one photographic constituent layer containing a photosensitive silver halide, an organic silver salt, a reducing agent, a dye donor substance, and a binder, in which the photographic constituent layer contains a thermal solvent, and a selected gelatin and a specific polymer binder. As is obvious from the description of the aforesaid Patent Publication, vinyl pyrolidone polymer is one of the examples of polymer binders, however, it is not given as one of the particularly preferred examples at present. Under these circumstances, it is marvelous that the objects of the invention can be attained by adopting such vinyl pyrolidone polymer as well as gelatin as the binders and by using such thermal solvent as an inevitable constituent element.

Constituents of the Invention

The invention will be described in detail as follows:

Binders to be used in the photographic constituent layers of the photosensitive elements of the invention are gelatin and vinyl pyrolidone polymer. Vinyl pyrolidone polymer to be used in the invention (hereinafter referred to as the polymer of the invention) may be a polyvinyl pyrolidone which is a vinyl pyrolidone homopolymer, and may also be a copolymer, including a graft copolymer, which is polymerized vinyl pyrolidone with one or not less than two other polymerizable monomers. These polymers may be used regardless of the degree of the polymerization. Such polyvinyl pyrolidone may also be a substituted polyvinyl pyrolidone. The preferable polyvinyl pyrolidones are those of 1,000~400,000 in molecular weight. As for the other monomers copolymerizable with vinyl pyrolidone, there may be given vinyl monomers including, for example, (metha)acrylic ester such as acrylic acid, methacrylic acid and the alkylic esters thereof, vinyl alcohols, vinyl imidazoles, (metha)acrylamides, vinyl carbinols, vinyl alkyl ethers, and the like. It is preferred that at least 20% (by weight—The same applies correspondingly to the following.) of the composition is polyvinyl pyrolidone. The preferable examples of such copolymers are those of 5,000~400,000 in molecular weight.

Gelatins to be used in the invention may be either the lime-treated or the acid-treated, and may also be ossein gelatin, pigskin gelatin, hide-gelatin or a modified gelatin in which one of the above-mentioned gelatin is modified with an ester or phenyl carbamoyl.

The composition of the binders to be used in the invention is that at least 10~90% and more preferably 20~60% thereof is gelatin, and at least 5~90% and more preferably 10~80% thereof is the polymer of the invention.

Binders to be used in the invention may be allowed to contain the other macromolecular substances. The preferred substances are a mixture of gelatin of the invention, polyvinyl pyrolidone of 1,000~400,000 in molecular weight and other one or not less than two macromolecular substances, and a mixture of glatin of the invention, a vinyl pyrolidone copolymer of 5,000 to 400,000 in molecular weight and other one or not less than two macromolecular substances. As for the other macromolecular substances to be used in the invention, the examples there of include polyvinyl alcohol, polyacrylamide, polymethacrylamide, polyvinyl butyral, polyethylene glycol, polyethylene glycol ester, a protein such as a cellulose derivative, a natural substance such as a polysaccharide including starch and gum arabic. They may be contained at 0~85% and more preferably at 0~70% thereof.

The polymers of the invention may be cross-linked polymers, and in this case it is preferred to cross-linked after coating on a support (In this case, a cross-linking reaction is included provided the reaction is progressed by permitting is to stand in nature).

The amount of the binders used in the invention is generally 0.005 g to 100 g, and more preferably 0.01 g to 40 g per sq. meter of a support. The binders of the invention may be applied to at least one photographic constituent layer, however, in a multilayered construction, it is preferred to apply the binders to not less than two layers, and particularly to every layer.

Thermal solvent to be used in the photographic constituent layers of the photosensitive element of the invention may be a substance capable of accelerating a heat-development and/or a heat-image-transfer and it is more preferred that the substances are a solid, semisolid or liquid at room temperature and are to be dissolved or melted in a binder by heating. The preferable examples are an urea derivative, an amide derivative, a polyethylene glycol, a polyhydric alcohol, or the like. These thermal solvent may be used independently or in combination. It is preferred that these thermal solvent are not only capable of improving the image transferability of dyes but also capable of improving the developability and releasability or formability thereof. In addition, the melting points of the thermal solvent of the invention are not required to be lower than the temperature for heat-developments, and the thermal solvent may also be a liquid at room temperature.

In the case that the described photographic constituent layers have a multilayered construction of not less than two layers, it is enough to apply a thermal solvent of the invention to at least one photographic constituent layer, however, it is no matter what the embodiments of the thermal solvent may be, such as that it may be contained in every photosensitive layer having a different tone from each other, it may be contained in an interposed layer between the lowest photosensitive layer and a support, and the like.

Next, the following is the description of the thermal solvent to be preferably used in the invention:

As for the urea derivatives, the preferable ones have the following Formula (1):

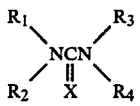

Formula (1)

wherein, X is an oxygen atom or a sulphur atom; $R_1$, $R_2$, $R_3$ and $R_4$ each are a hydrogen atom, a substituted or non-substituted alkyl radical having not more than 12 carbon atoms, in which a ring may be formed by coupling $R_1$ to $R_2$ or $R_3$ to $R_4$; or a substituted or non-substituted aryl radical having not more than 12 carbon atoms, respectively, and they are either the same or the different from each other.

As for the amide derivatives, the preferable ones have the following Formula (2):

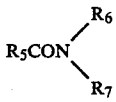

Formula (2)

wherein $R_5$ is a substituted or non-substituted alkyl radical having not more than 12 carbon atoms or a substituted or non-substituted aryl radical having not more than 12 carbon atoms; $R_6$ and $R_7$ may be the same with or different from each other and represent respectively a hydrogen atom, a substituted or non-substituted alkyl radical having not more than 6 carbon atoms, a substituted or non-substituted aryl radical having not more than 12 carbon atoms or an acyl radical having not more than 6 carbon atoms; and $R_5$ and $R_6$ may be coupled to each other to form a ring. The preferred polyethylene glycols have a molecular weight of 150 to 10,000.

The preferred polyhydric alcohols are those alcohols each having not more than 12 carbon atoms in total and two to six hydroxy radicals and forming a ring or a chain which may be substituted by a halogen atom, alkoxy radical, acyl radical or the like.

The concrete examples of urea derivatives include, urea, thiourea, 1,3-dimethylurea, 1,3-diethylurea, diethyleneurea, 1,3-diisopropylurea, 1,3-dibutylurea, 1,1-dimethylurea, 1,3-dimethoxyethylurea, 1,3-dimethylthiourea, 1,3-dibutylthiourea, tetramethylthiourea, phenylurea, tetramethylurea, tetraethylurea and the like.

The concrete examples of amide derivatives include, acetamide, propionamide, n-butylamide, i-butylamide, benzamide, diacetamide, dimethylformamide, acetanilide, ethylacetamide acetate, 2-chloropropionamide, 3-chloropropionamide, phthalimide, succinimide, N,N-dimethylacetamide and the like.

The concrete examples of polyhydric alcohols include, 1,6-hexanediol, dixylitol, pentaerythritol, 1,4-cyclohexanediol, 1,2-cyclohexanediol, 2,2'-dihydroxybenzophenone, 1,8-octanediol and the like.

The contents of the thermal solvent of the invention are 10 to 500% of the amount of the binders and more preferably 30 to 300% thereof. The thermal solvent of the invention may be used independently or in combination.

The color dye diffusion transfer type heat-developable photosensitive elements of the invention basically contain, besides the described binders and thermal solvent, the following four materials in one and the same layer;

(1) a photosensitive silver halide,
(2) an organic silver salt,
(3) a reducing agent, and
(4) a color dye doner substance.

The last mentioned color dye doner substance may be contained in the layer adjacent to a layer containing the other three kinds of the materials (i.e., a photosensitive silver halide, an organic silver salt and a reducing agent).

The photosensitive silver halides to be used in the invention include, for example, silver chloride, silver bromide, silver iodide, silver chlorobromide, silver chloroiodide, silver iodobromide, silver chloroiodobromide, and the like. These photosensitive silver halides may be prepared in such an arbitrary process as a single-jet process and a double-jet process which are well-known in photographic technical field. In this invention, however, a preferable result may be enjoyed with a photosensitive silver halide emulsion prepared in an process for preparing an ordinary type of silver halide gelatin emulsions.

The described photosensitive silver halide emulsion may be chemically sensitized in an arbitrary process which is well-known in photographic technical field. These sensitizing process include, for example, a gold-sensitization process, a sulphur sensitization process, a gold-sulphur sensitization process, a reduction sensitization process, and the like.

Silver halide to be contained in the described photosensitive emulsions may be either of a coarse grain type or of a fine grain type. The preferred grain size is about 1.5 μm, to about 0.001 μm, and more preferably about 0.5 μm, to about 0.01 μm, in diameter.

The above-mentioned photosensitive silver halide may preferably become ready to use by mixing with the polymers of the invention after sensitizing chemically, spectrally or otherwise in a gelatin solution. In other words, the silver halide sensitized by making use of a silver halide gelatin emulsion may be used in the binder prepared by mixing gelatin with the polymers of the invention.

Thus prepared photosensitive silver halide emulsion may most preferably be applied to a heat-developable photosensitive layer that is a photosensitive element constituent layer of the invention.

In a further process for preparing a photosensitive silver halide, a photosensitive silver halide may be formed in a part of an organic silver salt by making a photosensitive silver salt forming component co-exist with the organic silver salt.

As for the photosensitive silver salt forming components to be used in this process, there is given an inorganic halide including, for example, a halide represented by $MX_n$ (wherein M represents H atom, $NH_4$ radical or a metal atom; X represents Cl, Br or I; when M is H atom or $NH_4$ radical, n is I and when M is a metal atom, n is the valence thereof. Metal atoms include lithium, sodium, potassium, rubidium, cesium, copper, gold, beryllium, magnesium, calcium, strontium, barium, zinc, cadmium, mercury, aluminium, indium, lanthanum, ruthenium, thallium, germanium, tin, lead, antimony, bismuth, chromium, molybdenum, tungsten, manganese, rhenium, iron, cobalt, nickel, rhodium, palladium, osmium, iridium, platinum, cerium or the like.); halogen containing metal complexes include, for example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$, $(NH_4)_3RhBr_6$ and the like; onium halides include, for example, quaternary anmonium halides such as tetramethylanmonium bromide, trimethylphenylanmonium bromide, cetylethyldimethylanmonium bromide, 3-methylthiazolium bromide, trimethylbenzylanmonium bromide, quaternary phosphonium halides such as tetraethylphosphonium bromide, tertiary sulfonium halides such as benzylethylmethyl bromide, 1-ethylthiazolium bromide and the like; hydrocarbon halides include, for example, iodoform, bromoform, carbon tetrabromide, 2-bromo-2-methylpropane and the like; N-halogen compounds include N-chlorosuccinic acid imide, N-bromosuccinic acid imide, N-bromophthalic acid imide, N-bromoacetamide, N-iodosuccinic acid imide, N-bromophthalazinone N-chlorophthalazinone, N-bromoacetanilide, N,N-dibromobenzenesulfonamide, N-bromo-N-methylbenzenesulfonamide, 1,3-dibromo-4,4-dimethylhydantoin and the like; and other halogen containing compounds such as triphenylmethyl chloride, triphenylmethyl bromide, 2-bromobutyric acid, -bromoethanol and the like.

These photosensitive silver halides and photosensitive silver salt forming components may be used in combination in various processes. The amount used is 0.001 to 3.0 mol per mol of an organic silver salt and preferably 0.01 to 1.0 mol.

The heat-developable color photosensitive element of the invention may take the form of a multiplicity of layers sensitive respectively to a blue light, a green light and a red light, i.e., a heat-developable blue-sensitive layer, a heat-developable green-sensitive layer and a heat-developable red-sensitive layer.

Each of the blue-sensitive silver halide emulsion, the green-sensitive silver halide emulsion and the red-sensitive silver halide emulsion to be used therein may be prepared by adding various type of spectral sensitizing dyes to the described silver halide emulsions, respectively.

The typical spectral-sensitizing dyes to used in the invention include, for example, a cyanine, a merocyanine, a trinuclear or tetranuclear complex cyanine, a holopolar cyanine, styryl, hemicyanine, oxonol and the like. Among the cyanine dyes, the preferred ones are those having such a basic nucleus as thiazoline, oxazoline, pyrroline, pyridine, oxazole, thiazole, selenazole, imidazole and the like. These nuclei may have an alkyl group, an alkylene group, a hydroxyalkyl group, a sulfalkyl group, a carboxyalkyl group, an aminoalkyl group, or an enamine group which is capable of producing a condensed carbon ring or a heterocyclic ring. They may also be the symmetric or asymmetric. The methine chain or polymethine chain thereof may be allowed to have an alkyl group, a phenyl group, an enamine group, or a heterocyclic substituent.

Merocyanine dye may be allowed to have, besides the described basic nuclei, such an acid nucleus as a thiohydantoin nucleus, a rhodanine nucleus, an oxazolidinedion nucleus, a thiazolidinedion nucleus, a barbituric acid nucleus, a thiazolinthion nucleus, a malononitrile nucleus, and a pyrazolone nucleus. These acid nuclei may further be substituted by an alkyl group, an alkylene group, a phenyl group, a carboxyalkyl group, a sulfoalkyl group, a hydroxyalkyl group, an alkoxyalkyl group, an alkylamine group, or a heterocyclic nucleus. These dyes may be allowed to use in combination, if necessary. In addition, it is also allowed to use in combination such a hypersensitizing additive which does not absorb the visible rays as an ascorbic acid derivative, an azaindene cadmium salt, an organic sulfonic acid and the like of which U.S. Pat. Nos. 2,933,390 and 2,937,089, for example, disclosed.

The amount of these dyes added is $1\times10^{-4}$ mol to 1 mol and, more preferably, $1\times10^{-4}$ mol to $1\times10^{-1}$ mol per mol of a silver halide or a silver halide forming components.

Organic silver salts used for the heat-developable color photosensitive element of the invention include those of: aliphatic carboxylic acid such as silver laurate, silver myristate, silver palmitate, silver stearate, silver arachidonate, silver behenate and the like; aromatic carboxylic acid such as silver benzoate, silver phthalate and the like; imino-radical-having compounds such as benzotriazole, saccharin, phthalazinone, phthalimide and the like; mercaptoor thion-radical-having compounds such as 2-mercapto benzoxazole, mercapto oxadiazole, mercapto benzothiazole, -mercapto-benzimidazole, 3-mercapto phenyl-1,2,4-triazole and the like; 4-hydroxy-6-methyl-1,3,3a,7-tetrazaindene, -methyl-7-hydroxy-1,2,3,4,6-pentazaindene and the like. They are described in Japanese Patent Examined Publication Nos. 924/1968, 26582/1969, 18416/1970, 12700/1970 and 22185/1970, and Japanese Patent O.P.I. Publication Nos. 52626/1974, 31728/1977, 13731/1977, 141222/1977, 36224/1978 and 37610/1978, and U.S. Pat. Nos. 3,330,633 and 4,168,980. Such silver compounds may be used as described in Research Disclosure Nos. 16966, and 16907, and British Pat. Nos. 1590956, and 1590957. Among them, silver salts of those having imino radicals such as benzotriazole are preferred.

Silver salts of benzotriazole include those of: alkyl substituted benzotriazole such as methylbenzotriazole; halogen substituted benzotriazole such as bromo benzotriazole, chloro benzotriazole; amide substituted benzotriazole such as 5-acetamide benzotriazole; compounds described in British Pat. Nos. 1,590,956 and 1,590,957, such as N-(6-chloro-4 N-(3,5-dichloro-4-hydroxyphenyl)imino-1-oxo-5-methyl-2,5-cyclohexadiene-2-yl)-5-carbamoyl benzotriazole, 2-benzotriazole-5-ylazo-4-methoxy-1-naphthol, 1-benzotriazole-5-ylazo-2-naphthol, N-benzotriazole-5-yl-4--(4-dimethylaminophenylazo)benzamide or the like.

Also, nitrobenzotriazoles having the following Formula (3) and benzotriazoles having the Formula (4) may advantageously be used:

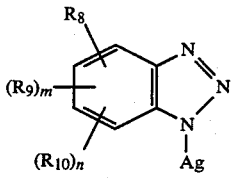

Formula (3)

wherein, $R_8$ represents a nitro group; $R_9$ and $R_{10}$ may be the same with or the different from each other and represents respectively a halogen atom such as chlorine, bromine or iodine, a hydroxy group, a sulfo group or the salt thereof such as a sodium salt, a potassium salt, or an ammonium salt, a carboxy group or the salt thereof such as a sodium salt, a potassium salt or an ammonium salt, a nitro group, a cyano group or a carbamoyl group each of which may have a substituent, a sulfamoyl group, an alkyl group such as a methyl group, an ethyl group or a propyl group, an alkoxy group such as a methoxy group or an ethoxy group, an aryl group such as a phenyl group, or an amino group; m is an integer of 0~2; and n is an integer of 0~1. The substituents of the described carbamoyl group include, for example, a methyl group, an ethyl group, an acetyl group and the like. The substituents of the sulfamoyl group include, for example, a methyl group, an ethyl group, an acetyl group and the like. The substituents of the alkyl group include, for example, a carboxy group, an ethoxycarbonyl group and the like. The substituents of the aryl group include, for example, a sulfo group, a nitro group and the like. The substituents of the alkoxy group include, for example, a carboxy group and an ethoxycarbonyl group. The substituents of the amino group include, for example, an acetyl group, a methanesulfonyl group, a hydroxy group.

The compounds each having the above Formula (3) are silver salts of benzotriazole derivatives each having at least one nitro group. The concrete examples thereof may be given as the following silver salts of: 4-nitrobenzotriazole, 5-nitrobenzotriazole, 5-nitrobenzotriazole, 5-nitro-6-chlorobenzotriazole, 5-nitro-6-methylbenzotriazole, 5-nitro-6-methoxybenzotriazole, 5-nitro-7-phenylbenzotriazole, 4-hydroxy-5-nitrobenzotriazole, 4-hydroxy-7-nitrobenzotriazole, 4-hydroxy-5,7-dinitrobenzotriazole, 4-hydroxy-5-nitro-6-chlorobenzotriazole, 4-hydroxy-5-nitro-6-methylbenzotriazole, 4-sulfo-6-nitrobenzotriazole, 4-carboxy-6-nitrobenzotriazole, 5-carboxy-6-nitrobenzotriazole, 4-carbamoyl-6-nitrobenzotriazole, 4-sulfamoyl-6-nirobenzotriazole, 5-carboxymethyl-6-nitrobenzotriazole, 5-hydroxycarbonylmethoxy-6-nitrobenzotriazole, 5-nitro-7-cyanobenzotriazole, 5-amino-6-nitrobenzotriazole, 5-nitro-7-(p-nitrophenyl)-benzotriazole, 5,7-dinitro-6-methylbenzotriazole, 5,7-dinitro-6-chlorobenzotriazole, 5,7-dinitro-6-methoxybenzotriazole, and the like.

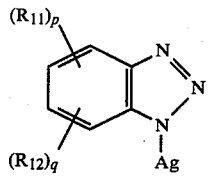

Formula (4)

wherein $R_{11}$ represents a hydroxy group, a sulfo group or the salt thereof such as a sodium salt, a potassium salt or an ammonium salt, a carboxy group or the salt thereof such as a sodium salt, a potassium salt or an ammonium salt, a carbamoyl group which is allowed to have a substituent, or a sulfamoyl group which is allowed to have a substituent $R_{12}$ represents a halogen atom such as chlorine, bromine or iodine, a hydroxy group, a sulfo group or the salt thereof such as a sodium salt, a potassium salt or an ammonium salt, a carboxy group or the salt thereof such as a sodium salt, a potassium salt or an ammonium salt, a nitro group, a cyano group, or an alkyl group such as a methyl group, an ethyl group or a propyl group, an aryl group such as a phenyl group, an alkoxy group such as a methoxy group or an ethoxy group, or an amino group which are allowed to have a substituent; p is an integer of 1 or 2; and q is an integer of 0~2.

The substituents of the carbamoyl group represented by the $R_{11}$ include, for example, a methyl group, an ethyl group, an acetyl group and the like. The substituents of the sulfamoyl group include, for example, a methyl group, an ethyl group, an acetyl group and the like. The substituents of the alkyl group represened by the $R_{12}$ include, for example, a carboxy group, an ethoxycarboxyl group and the like. The substituents of the aryl group include, for example, a sulfo group, a nitro group and the like. The substituents of the alkoxy group include, for example, a carboxy group, an ethoxycarboxyl group and the like. The substituents of the amino group include, for example, an acetyl group, a methanesulfonyl group, a hydroxy group, and the like.

The concrete examples of the organic silver salts each having the Formula (4) include the following silver salts of:

4-hydroxybenzotriazole, 5-hydroxybenzotriazole, 4-sulfobenzotriazole, 5-sulfobenzotriazole, benzotriazole silver-4-sodium sulfonate, benzotriazole silver-5-sodium sulfonate, benzotriazole silver-4-potassium sulfonate, benzotriazole silver-5-potassium sulfonate, benzotriazole silver-4-ammonium sulfonate, benzotriazole silver-5-ammonium sulfonate, 4-carboxy benzotriazole, 5-carboxy benzotriazole, benzotriazole silver-4-sodium carbonate, benzotriazole silver-5-sodium carbonate, benzotriazole silver-4-potassium carbonate, benzotriazole silver-5-potassium carbonate, benzotriazole silver-4-ammonium carbonate, benzotriazole silver-5-ammonium carbonate, 5-carbamoyl benzotriazole, 4-sulfamoyl benzotriazole, 5-carboxy-6-hydroxy benzotriazole, 5-carboxy-7-sulfo benzotriazole, 4-hydroxy-5-sulfo benzotriazole, 4-hydroxy-7-sulfo benzotriazole, 5,6-dicarboxy benzotriazole, 4,6-dihydroxy benzotriazole, 4-hydroxy-5-chloro benzotrizole, 4-hydroxy-5-methoxy benzotriazole, 4-hydroxy-5-nitrobenzotriazole, 4-hydroxy-5-cyano benzotriazole, 4-hydroxy-5-amino benzotriazole, 4-hydroxy-5-acetamide benzotriazole, 4-hydroxy-5-benzenesulfonamide benzotriazole, 4-hydroxy-5-hydroxycarbonylmethoxy benzotriazole, 4-hydroxy-5-ethoxycarbonylmethoxy benzotriazole, 4-hydroxy-5-carboxymethyl benzotriazole, 4-hydroxy-5-ethoxycarbonylmethyl benzotriazole, 4-hydroxy-5-phenyl benzotriazole, 4-hydroxy-5-(p-nitrophenyl)benzotriazole, 4-hydroxy-5-(p-sulfohenyl)benzotriazole, 4-sulfo-5-chloro benzotriazole, 4-sulfo-5-methyl benzotriazole, 4-sulfo-5-methoxy benzotriazole, 4-sulfo-5-cyano benzotriazole, 4-sulfo-5-amino benzotriazole, 4-slfo-5-acetamide benzotriazole, 4-sulfo-5-benzenesulfonamide benzotriazole, 4-sulfo-5-hydroxycarbonylmethoxy benzotriazole 4-sulfo-5-ethoxycarbonylmethoxy benzotriazole, 4-hydroxy-5-carboxy benzotriazole, 4-sulfo-5-carboxymethyl benzotriazole, 4-sulfo-5-ethoxycarbonylmethyl benzotriazole, 4-sulfo-5-phenylbenzotriazole, 4-sulfo-5-(p-nitrophenyl)benzotriazole, 4-sulfo-5-(p-sulfophenyl)benzotriazole, 4-sulfo-5-methoxy-6-chloro benzotriazole, 4-sulfo-5-chloro-6-carboxy benzotriazole, 4-carboxy-5-chloro benzotriazole, 4-carboxy-5-methyl benzotriazole, 4-carboxy-5-nitro benzotriazole, 4-carboxy-5-amino benzotriazole, 4-carboxy-5-methoxy benzotriazole, 4-carboxy-5-acetamide benzotriazole, 4-carboxy-5-ethoxycarbonylmethoxy benzotriazole, 4-carboxy-5-carboxymethyl benzotriazole, 4-carboxy-5-phenyl benzotriazole, 4-carboxy-5-(p-nitrophenyl)benzotriazole, 4-carboxy-5-methyl-7-sulfo benzotriazole, and the like. These compounds may be used independently or in combination. It is allowed to use the organic silver salts relating to the invention in the manner that they are isolated and are then dispersed in the binders of the invention by the use of an appropriate means, or in the manner that the silver salts are prepared in the binders of the invention without isolation. How to prepare the organic silver salts of the invention will be described later.

The amount of the organic silver salt used is 0.05 g to 0.0 g per sq. m of a support and more preferably 0.2 g to 2.0 g.

The reducing agents which may be used with the heat-developable color photosensitive elements include, for example, p-phenylenediamine and p-aminophenol developing agents, phosphoramidephenol and sulfonamidephenol developing agents, and hydroazone type color developing agents described in U.S. Pat. Nos. 3,531,286, 3,761,270 and 3,764,328, and Research Disclosure Nos. 12146, 15108 and 15127, and Japanese Patent O.P.I. Publication No. 27132/1981; and these are advantageously used in the case of the thermal transferable dye doner substances described in Japanese Patent O.P.I. Publication No. 186744/1982 and Japanese Patent Application Nos. 122596/1982, 160698/1982, 126054/1982, 33363/1983, 33364/1983 and the like. In this case, diffusible dyes produced by an oxidation coupling of the reducing agent to the thermal transferable dye donor substance are released or formed. Color developing agent precursors such as those described in U.S. Pat. Nos. 3,342,599, and 3,719,492, Japanese Patent O.P.I. Publication Nos. 135628/1978 and 79035/1979, and the like, may also be used advantageously.

The other color systems are disclosed in for example, Japanese Patent O.P.I. Publication Nos. 179840/1982 and 102487/1982, and Japanese Patent Application Nos. 229648/1982, 229672/1982, and the like, and these systems do not always require the described reducing agents to used, but the following reducing agents may be used in these systems;

A phenol such as p-phenylphenol, p-methoxyphenol, 2,6-di-t-butyl-p-cresol, N-methyl-p-aminophenol and the like; a sulfonamide phenol such as 4-benzenesulfonamide phenol, 2-benzenesulfonamide phenol, 2,6-dichloro-4-benzenesulfonamide phenol, 2,6-dibromo-4-(p-toluenesulfonamide)phenol, and the like; a polyhydroxy benzene such as hydroquinone t-butyl hydroquinone, 2,6-dimethyl hydroquinone, chloro hydroquinone, carboxy hydroquinone, catechol, 3-carboxy catechol and the like; a naphthol such as α-naphthol, β-naphthol, 4-aminonaphthol, 4-methoxynaphthol, and the like; a hydroxy binaphthyl and a methylene bisnaphthol such as 1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, 4,4'-dimethoxy-1,1'-dihydroxy-2,2'-binaphthyl, bis(2-hydroxy-1-naphthyl)methane, and the like; a methylene bis-phenol such as 1,1'-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, 2,6-methylene bis(2-hydroxy-3-t-butyl-5-methylphenyl)-4-methylphenol-α-phnenyl-α,α-bis(2-hydroxy-3,5-di-t-butylphenyl)methane, α-phenyl-α,α-bis(2-hydroxy-3-t-butyl-5-methylphenyl)methane, 1,1-bis(2-hydroxy-3,5-di-methylphenyl)-2-methyl propane, 1, 1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3-methyl-5-t-butylphenyl)propane, 2,2-bis(4-hydroxy-3,5-di-t-butylphenyl)propane and the like; an ascorbic acid; a 3-pyrazolidone, a pyrazolone, a hydrozone, and paraphenylene diamine.

These reducing agents may be used independently or in combination. The amount of the reducing agent used depends upon the kinds of organic silver salts, photosensitive silver halides and other additives, and is normally between 0.05 mol and 10 mol per mol of organic silver salt and preferably between 0.1 mol and 3 mol.

As for the color dye donor substances of the invention. Those described in, for example, Japanese patent O.P.I. Publication Nos. 179840/1982 and 186744/1982 and Japanese Patent Application Nos. 122596/1982, 224883/1982, 224884/1982, 205447/1982. 225928/1982, 229648/1982, 229672/1982, 33363/1983, 33364/1982 which have been applied by the inventors, and the like. In particular, the preferred ones are those each having a water-soluble group, described in Japanese Patent Application Nos. 33363/1983 and 33364/1983. Those dye donor substances are substantially immobilized in the binder of the invention even in the course of a thermal development. Therefore, no color-turbidity is caused by a diffusion between the layers of color dye donor substances.

As the result of a thermal development, the above-mentioned color dye donor substances release or form thermally diffusive dyes imagewise, and the released or formed dyes are diffused and are transferred to an image receiving element.

The concrete examples of the color dye donor substances preferably usable in the invention are given below:

[color dye donor substance]
(1)
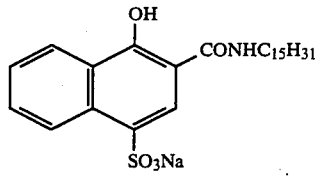
(2)
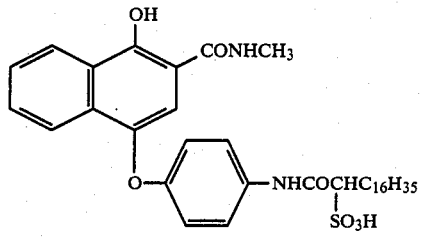
(3)
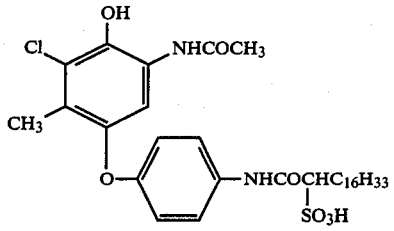
(4)
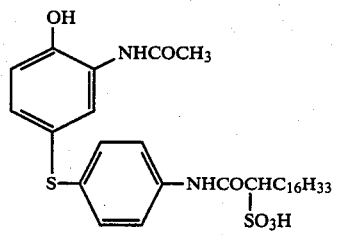
(5)
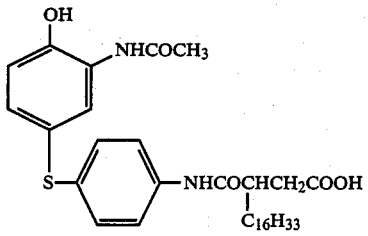
(6)
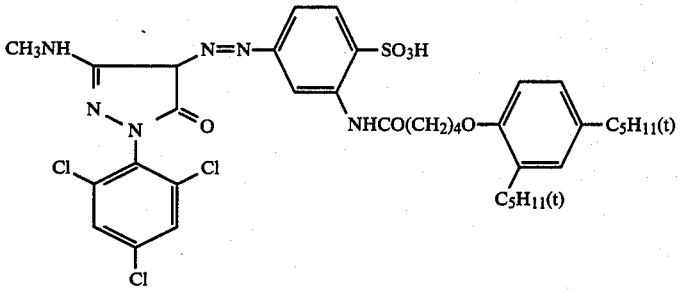
(7)
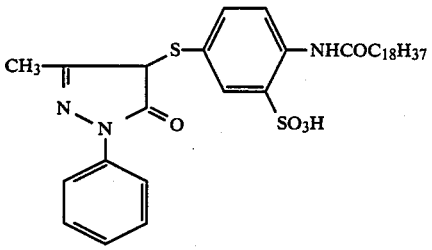
(8)
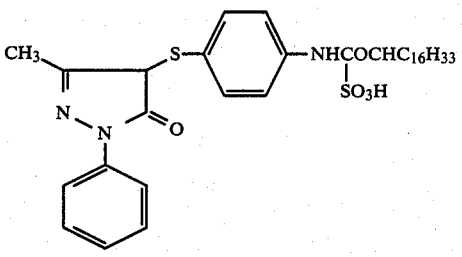
(9)
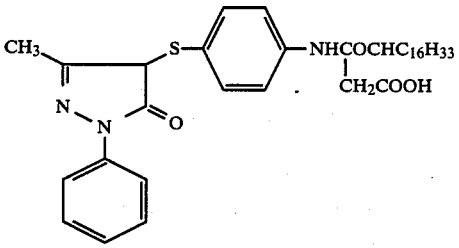
(10)
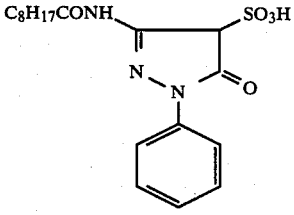

-continued
[color dye donor substance]
(11)
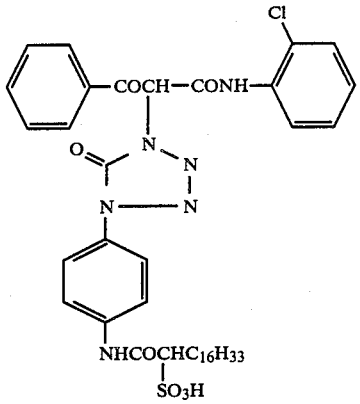
(12)
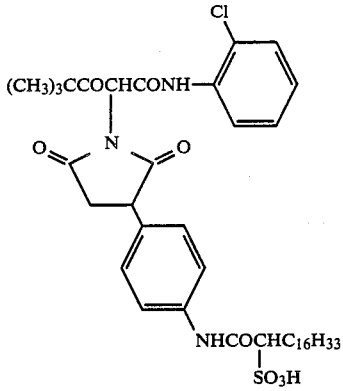
(13)
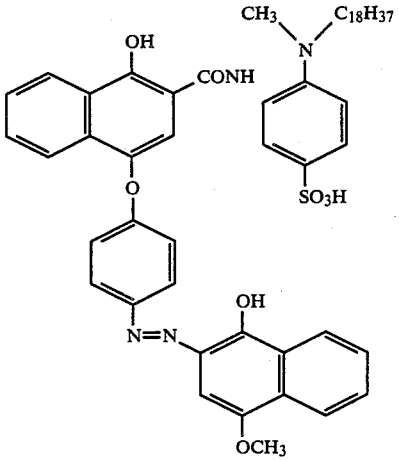
(14)
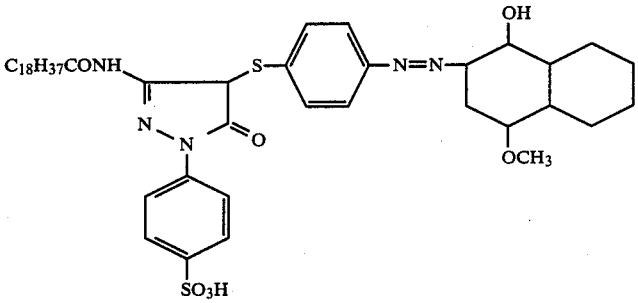
(15)
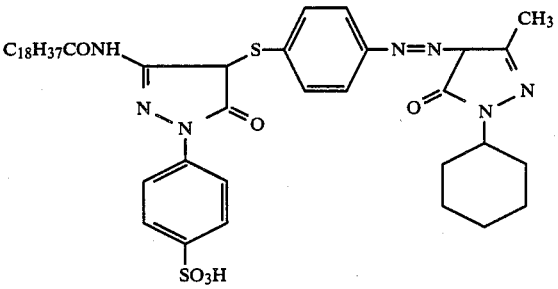
(16)
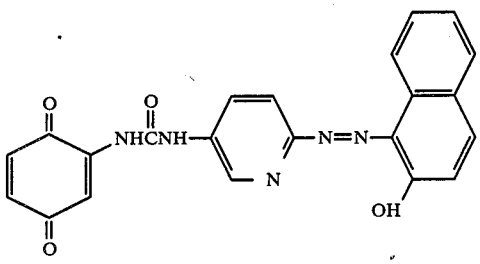

-continued

[color dye donor substance]

(17)

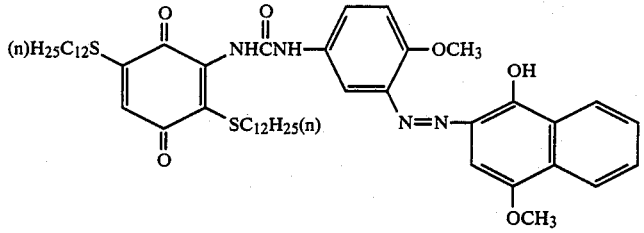

(18)

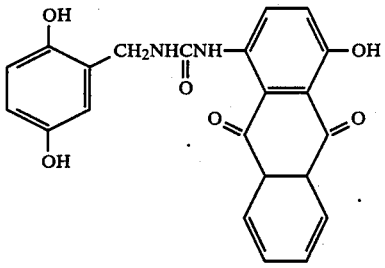

(19)

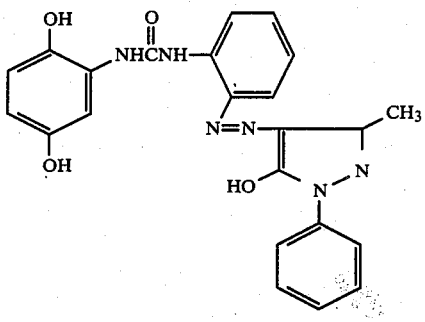

(20)

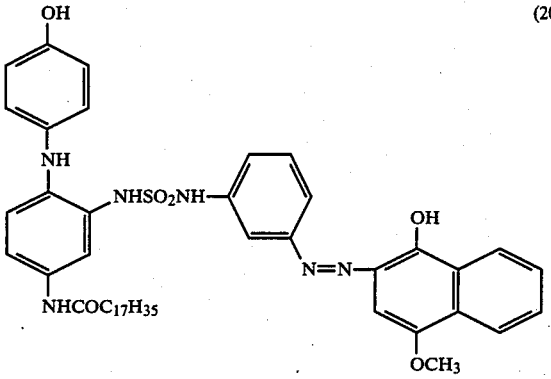

(21)

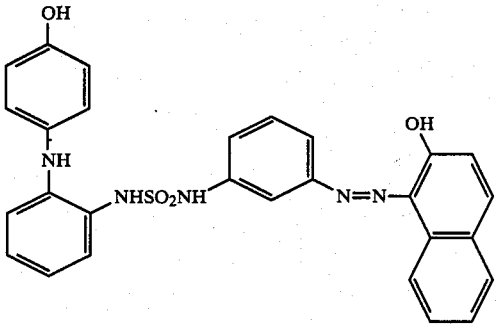

(22)

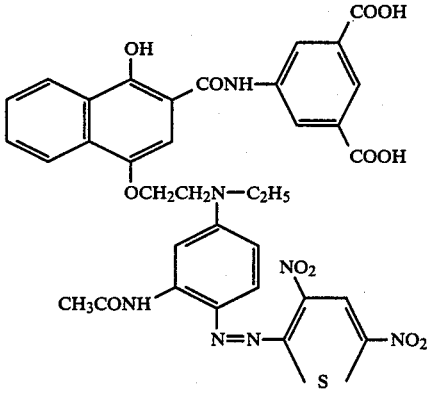

(23)

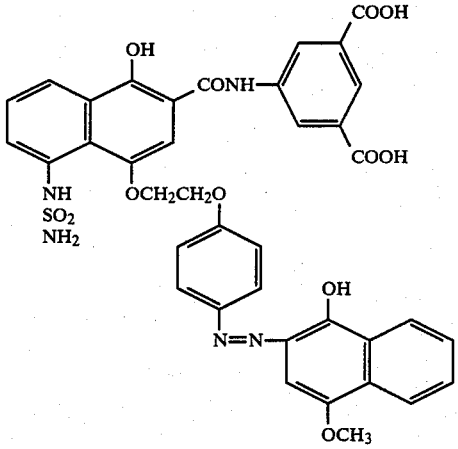

The above-mentioned color dye donor substance forms a dye through the coupling reaction with a color developing agent which serves as a reducing agent {e.g., Examples (1) to (12) and the like of the color dye donor substances}; it releases a dye through a coupling reaction {e.g., Examples (13) to (15) and the like of the color dye donor substances}; or it releases a dye or transforms into a non-releasable substance through an oxidation reaction or a reduction reaction {e.g., Examples (16) to (23) and the like of the color dye donor substances} and thereby a thermally diffusive dye is released or formed imagewise; and then, the dye is thermally diffused to transfer to an image receiving layer. In the binders of the photosensitive element of the invention, the color dye is thermally transferred very excellently with the aid of the functions of a thermal solvent to render a satisfactory density within a short time; and the dyes are satisfactorily transferred even from the lowermost layer when the photosensitive element is multilayered.

Diffusion transfer type heat-developable color photosensitive elements of the invention may be added with various kinds of additives if occasion demands, besides the above-mentioned components. For example, developement accelerators include alkali releasing agents such as those described in U.S. Pat. Nos. 3,220,846, 3,531,285, 4,012,260, 4,060,420, 4,088,496, and 4,207,392, or Research Disclosure Nos. 15733, 15734 and 15776; organic acids such as those described in Japanese Patent Examined Publication No. 12700/1970; non-aqueous polar solvent compounds each having —CO—, —$SO_2$—, or —SO— group such as those described in U.S. Pat. No. 3,667,959; and tone modifiers include those described in, for example, Japanese Patent O.P.I. Publication Nos. 4928/1971, 6077/1971, 5019/1974, 5020/1974, 91215/1974, 107727/1974, 2524/1975, 67132/1975, 67641/1975, 114217/1975, 33722/1977, 99813/1977, 1020/1978, 55115/1978, 76020/1978, 125014/1978, 156523/1979, 156524/1979, 156525/1979, 156526/1979, 4060/1980, 4061/1980, 32015/1980 and the like, German Pat. Nos. 2,140,406, 2,417,063, and 2,220,618, and U.S. Pat. Nos. 3,080,254, 3,847,612, 3,782,941, 3,994,732, 4,123,282, 4,201,582 and the like, such as phthalazinone, phthalimide, pyrazolone, quinazolinone, N-hydroxynaphthalimide, benzoxazine, naphthoxazinedione, 2,3-dihydro-phthalazinedione, 2,3-dihydro-1,3-oxazine-2,4-dione, oxypyridine, aminopyridine, hydroxyquinoline, aminoquinoline, isocarbostyryl, sulfonamide, 2H-1,3-benzothiazine-2,4-(3H)dione, benzotriazine, mercaptotriazole, dimercaptotetrazapentalene, phthalic acid, naphthalic acid, phthalamic acid and the like. The tone modifiers also include the mixtures of one or a plurality of the above-mentioned toner modifiers and an imidazole compounds, the mixtures of at least one of acids such as phthalic acid naphthalic acid or acids anhydride and a phthalazine compound, or a combination of phthalazine with maleic acid, itaconic acid, quinolinic acid, gentisic acid and the like. The affective tone modifiers also include a 3-amino-5-mercapto-1,2,4-triazole and a 3-acylamino-5-mercapto-1,2,4-triazole described in Japanese Patent Application Nos. 73215/1982 and 76838/1982.

Further, antifoggants include, for example, a mercuric salt, an oxidizer such as an N-halogenacetamide, an N-halogenosuccinimide, perchloric acid and the salts thereof, an inorganic peroxide, a persulfate and the like, an acid or the salts thereof such as sulfinic acid, lithium laurate, rosin, diterpenic acid, thiosulfonic acid and the like, a sulphur containing compound such as a mercapto compound releasable compound, thiouracil, disulfide, a simple sulphur substance, mercapto-1,2,4-triazole thiazolinethione, a polysulfide compound and the like, and, in addition, oxazoline, 1,2,4-triazole, and phthalimide are also included. They are described in, for example, Japanese Patent Examined Publication No. 11113/1972, Japanese Patent O.P.I. Publication Nos. 90118/1974, 10724/1974, 97613/1974, 101019/1975, 130720/1974, 123331/1975, 474191/1976, 57435/1976, 78227/1976, 104338/1976, 19825/1978, 20923/1978, 50725/1976, 3223/1976, 42529/1976, 81124/1976, 51821/1979 and 93149/1980, British Pat. No. 1455271, U.S. Pat. Nos. 3885968, 3700457, 4137079 and 4138265, German Pat. No. 2617907 a print-out inhibitor may simultaneously be used as a stabilizer particularly for an after-treatment. They include, for example, a halogenated hydrocarbon described in Japanese Patent O.P.I. Publication Nos. 45228/1973, 119624/1975, 120328/1975, 46020/1978 and the like, such as tetrabromobutane, tribromoethanol, 2-bromo-2-tolylacetamide, 2-bromo-2-tolylsulfonylacetamide, 2-tribromomethylsulfonyl benzothiazole, 2,4-bis(tribromomethyl)-6-methyltriazine and the like.

An after-treatment may also be carried out by means of a sulphur containing compound described in Japanese Patent Examined Publication No. 5393/1971 and Japanese Patent O.P.I. Publication Nos. 54329/1975 and 77034/1975.

Further, an isothiouronium stabilizer precursor described in U.S. Pat. Nos. 3,301,678, 3,506,444, 3,824,103, and 3,844,788 and an acitvator stabilizer precursor described in U.S. Pat. Nos. 3,669,670, 4,012,260 and 4,060,420 may be contained therein.

Still further, the heat-developable color photosensitive elements of the invention may also be added, if required, with various additives, coating assistants and the like such as a spectrally sensitizing dye, antihalation dye, fluorescent sensitizer, hardener, an antistatic agent, a plasticizer, a spreading agent and the like, besides the above-mentioned components.

The color diffusion transfer type photosensitive elements relating to the invention may be provided with various kinds of the photographic component layers such as an upper polymer layer, a sublayer, a backing layer, an interlayer, and a filter layer according to the purposes, besides the photosensitive layers.

The photosensitive layers and the other photographic component layers relating to the invention are to be coated over to anyone of various types of support covering a wide range. The supports to be used in the invention include plastic films such as a cellulose nitrate film, a cellulose ester film, a polyvinylacetal film, a polyethylene film, a polyethyleneterephthalate film, a polycarbonate film and the like, glass plate, paper, metals such as aluminium. In addition, a baryta paper, a resin-coated paper and a water-proof paper are also usable.

Color diffusion transfer type heat-developable photosensitive element of the invention provides an image receiving layer with a color image through the processes of an imagewise exposure, a development under a heat-treatment and a thermal transfer to the image receiving layer which is relatively laminated with the photosensitive element.

It is fundamentally satisfactory that the above-mentioned image receiving layer can function enough to stop and fix the transfer of the image distribution of thermally transferred dyes.

For example, a simple gelatin layer or other synthetic polymer layer is competent, and a wood pulp layer or other synthetic pulp layer is also competent. Various types of mordants may further be used. The image receiving layer may be contained in a layer coated on an appropriate support, or a support is allowed to serve as the image receiving layer by itself. The image receiving layer may also be formed on one and the same support of the above-mentioned photosensitive element. The image receiving layer may be peeled off after a dye image is transferred thereto, and it may also be united in a body with the photosensitive layer. If occasion demands, an opaqued layer may further be incorporated. This kind of layers are used for reflecting a desired amount of radiation such as visible ray of light which may be used for observing a dye image of the image receiving layer. Such opaqued layer may contain various reagents such as titanium dioxide capable of giving a necessary reflection.

Each layer as well as an image receiving layer which are to be contained in a photosensitive element of the invention may be prepared in the manner that the respective coating liquids for the above-mentioned layers are prepared to use in various coating methods such as a dipping method, an air-knife coating method, a curtain coating method, a hopper coating method described in U.S. Pat. No. 3,681,294, and the like. In addition, two or more layers can be coated at the same time, if required, in the methods described in U.S. Pat. No. 2,761,791 and in British Pat. No. 837,095.

A variety of exposure means may be applied to the color diffusion transfer type heat-developable photosensitive elements of the invention. A latent image can be obtained by an imagewise exposure to rays of radiant light including visible rays of light.

The light sources for this purpose generally include for example, a tungsten lamp, a mercury lamp, a xenon lamp, laser beams, CRT rays and the like which are normally used for color printing.

As an original drawing, not only a line drawing of a drafting but also a photographic image pattern with gradation are competent. Print-out of an original drawing may also be a contact print-out.

It is also possible to print out an image projected from a video camera or the like, or an image information transmitted from a TV station in the manner that such an image is projected direct onto a CRT or an FOT to focus on a heat-developable photosensitive element by means of a contact print or a lens.

An LED (a light emitting diode) which is recently showing remarkable progress is being used to serve as an exposing means or a displaying means in various equipments. It is however difficult to produce an LED capable of effectively emitting a blue light.

To reproduce a color image in this case, it is competent to use LEDs capable of respectively emitting a green light, a red light and an infrared light, and to design the respective layers sensitive to these lights so as to release yellow, magenta and cyan dyes. In other words, it will do if a green-sensitive layer is to contain a yellow dye donor substance, a red-sensitive layer is to contain a magenta dye donor substance and an infrared-sensitive layer is to contain a cyan dye donor substance.

Besides the method in which the described original drawing is directly brought into contact or is projected, there is a method in which an original drawing irradiated by a light source is read through a phototube or through such a photoreceptor element as a charge coupled device or the like, and the information which was thus read is fed into the memory of a computer or the like so as to be applied, if necessary, with such a processing as the so-called image processing, and is then reproduced on a CRT to utilize the image information as an imagewise light source; and there is also another method in which the rays of light are directly emitted by three kinds of diodes respectively so as to expose thereto.

The correlationship between the photosensitive element of the invention and an image receiving layer which is to be used in combination therewith may be satisfied by any type of the conventionally known photosensitive elements. For example, the correlationship is allowed to be any one of (1) the correlation in which an image receiving layer is laminated to the photographic component layer of a photosensitive element of the invention when a heat-development is carried out; (2) the correlation in which an image receiving layer is laminated to the photographic component layer of a photosensitive element of the invention when a thermal transfer is carried out after a heat-development was completed; and (3) the correlation in which the photographic component layer of a photosensitive element of the invention has an image receiving layer thereon in a body and an imagewise exposure and a heat-development are carried out through the image receiving layer; and the image receiving layer is allowed to be either of type (I) in which the image receiving layer is peeled off after a thermal transfer was carried out; and type (II) in which the image receiving layer is not peeled off after a thermal transfer was carried out.

In the invention, the term, "Thermal Transfer" means that a dye is sublimated, gasified, evaporated, or fused by heat, or is dissolved in a solvent, and is then diffused and transferred.

Thermal transfer from a photosensitive element of the invention to an image receiving layer (or an image receiving element) for thermal transfer use is carried out when the photosensitive element of the invention is heat-developed or when it is re-heated after such a heat-development was completed. Any heating method applicable to the ordinary types of heat-developable photographic materials can be utilized in this thermal transfer process. The heating methods for the thermal transfer process include, for example, that in which they are brought into contact with a heated block or a heated plate, that in which they are brought into contact with a heat roller or a heat drum, that in which they are made pass through an atmosphere of an elevated temperature, that in which a high frequency heating is applied, or that in which an electroconductive layer is provided into a photosensitive element of the invention or into an image receiving layer (or element) for thermal transfer use to utilize a juoule heat generated by an electrification or by a ferromagnetic field. The heating pattern is not limited, but a simple pattern is desired, though it is possible to apply such a method as that in which after a preheating is applied a re-heating is applied, that a heating is applied in a short time at an elevated temperature, that a heating is applied in a long time at a low temperature, that a heating is applied continuously with increasing or decreasing a temperature or with a repetition thereof, or that a heating is applied discontinuously. Normally, the heating temperature for a transfer is from 80° C. to 200° C. and is preferably from 80° C. to 160° C., and the heating time is from 1 second to 1 minute and is preferably within the range of 1 second to 40 seconds.

A heat-developing equipment having been placed on the market is readily used for thermally transferring with a photosensitive element of the invention. The equipments readily applicable include Image Forming Model 4634 (mfd. by Sony Techtronics), "Developer Module", Model 277 (mfd. by 3M), "Video Hard Copy Unit," Model NWZ-301 (mfd. by Nippon Musen Co.), and the like.

EXAMPLES

The examples of the invention will be described below, and it is to be understood that the invention shall not be limited thereto.

EXAMPLE 1

An experiment of a dye transferability was tried.

By making use of the following dye (a), (b) or (c) which was released from or formed of the exemplified dye donor substance, the transference was carried out with the system corresponding to a laminated layer as illustrated below:

Dye (A)

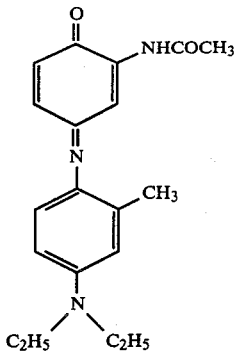

Dye (B)

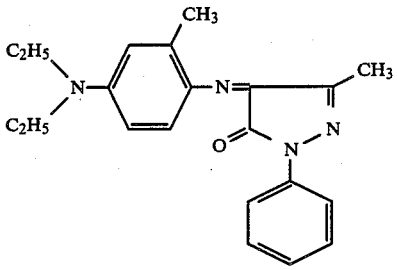

Dye (C)

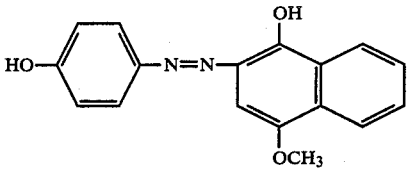

A solution of the following composition was prepared and was dispersed by means of an alumina ball mill. After then, the dispersed solution was coated on a gelatin sublayered polyethylene terephthalate base by means of a wire bar so that the coating could be 65 μm in wet thickness. The coated material was then dried to obtain a sample. In this sample, dimethyl urea {Thermal Solvent (A)} or pentaerythritol {Thermal Solvent (B)} was used as the thermal solvent.

| | |
|---|---|
| Dye (A), (B) or (C) | 0.395 g |
| Gelatin | 0.66 g |
| Polyvinyl pyrolidone (40,000 in molecular weight) | 1.54 g |
| Thermal solvent (A) or (B) | 1.32 g |
| Add water to make | 50 ml |

The solution of the following composition was coated on the sample obtained so that the coated thickness could be equivalent to 3 times of the coated thickness of the lower layer, and thus, the multilayered samples No. 1 to 6 were obtained, respectively.

| | |
|---|---|
| Gelatin | 1.98 g |
| Polyvinyl pyrolidone | 4.62 g |

-continued

| | |
|---|---|
| (40,000 in molecular weight) | |
| Thermal solvent (A) or (B) | 3.96 g |
| Add water to make | 50 ml |

For the control purpose, the multilayered samples for control (No. 7 to 15) were prepared, respectively. Some of them contained all gelatin and no polyvinyl pyrolidone as the binder thereof (the upper layers were the same) and the rest of them were not added with thermal solvent (the upper layer were the same).

These samples were laid respectively on top of an image receiving element bearing a polyethylene terephthalate base coated thereon with polyvinyl chloride. Thus laminated materials were hated for 35 seconds by a metal-made heat block of which the surface temperature was at 180° C. and were then tried to transfer the dyes. The results were obtained as per Table-1.

As is obvious from Table-1, it can be found that excellent dye transfer may be performed even in a multilayered system when the binder of the invention (gelation-polyvinyl pyrolidone) and the thermal solvent are used, however, in the control samples, a dye transfer is extremely rare in some samples or is none at all in the rest.

TABLE-1

| Sample | Binder | Thermal Solvent | Dye | Transfer Density |
|---|---|---|---|---|
| 1 | Gelatin + polyvinyl pyrolidone | A | (A) | 2.44 |
| 2 | Gelatin + polyvinyl pyrolidone | B | (A) | 2.25 |
| 3 | Gelatin + polyvinyl pyrolidone | A | (B) | 2.52 |
| 4 | Gelatin + polyvinyl pyrolidone | B | (B) | 2.34 |
| 5 | Gelatin + polyvinyl pyrolidone | A | (C) | 2.62 |
| 6 | Gelatin + polyvinyl pyrolidone | B | (C) | 2.43 |
| 7 | Gelatin | A | (A) | 0.35 |
| 8 | " | B | (A) | 0 |
| 9 | " | A | (B) | 0.32 |
| 10 | " | B | (B) | 0 |
| 11 | " | A | (C) | 0.38 |
| 12 | " | B | (C) | 0 |
| 13 | Gelatin + polyvinyl pyrolidone | nil | (A) | 0 |
| 14 | Gelatin + polyvinyl pyrolidone | " | (B) | 0 |
| 15 | Gelatin + polyvinyl pyrolidone | " | (C) | 0 |

EXAMPLE 2

To 7.26 g ($2.3\times10^{-2}$ mol) of 4-hydroxy benzotriazole silver, 1.8 g of gelatin, 4.2 g of polyvinyl pyrolidone (40,000 molecular weight) and 140 ml of water were added. The mixture was pulverized to disperse by an alumina ball mill. Thus, a silver salt dispersion liquid was obtained.

And, a solution comprising $1\times10^{12}$ mol of the described dye donor substance (3), 2.55 g of gelatin, 5.95 g of polyvinyl pyrolidone (40,000 in molecular weight) and 190 ml of water was dispersed by an alumina ball mill. Thus, a dispersion liquid of the dye donor substance was obtained.

Further, the mixture of 25 ml of the described silver salt dispersion liquid and 25 ml of the description dye donor-substance dispersion liquid was prepared. And the mixture was added with 2.0 g of pentaerythritol and 35 mg in silver equivalent of silver iodide emulsion having the average size of 0.04 μm, and was further added with 0.42 g of the following reducing agent and dissolved therein. Thus prepared material was coated on a photographic baryta paper so that the coating could be 65 μm in wet thickness by means of a wire bar, and dried. Thus, a sample of photosensitive element was obtained.

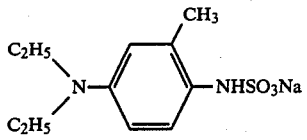

(Developer)

This sample was exposed to light of 30000 CMS, through a step wedge.

Next, an image receiving element which was similar to that of Example 1 was laid on the coated surface of this exposed sample. The laminated material was heated for 40 seconds by a metal-made heat block of which the surface temperature was at 160° C. and the polyethylene terephthalate base was then peeled off. The density of the dye transferred to the image receiving element was measured and the results was a cyan image having a maximum density of 1.67 and a minimum density of 0.11.

EXAMPLE 3

A solution of the following composition was coated on the sample of the photosensitive element of Example 2 so that the coating could be 65 μm in wet thickness, and was dried. When it was exposed to light and was developed by heat as in Example 2, a cyan image having a maximum density of 1.42 and a minimum density of 0.10 was obtained.

| | | |
|---|---|---|
| ( | Gelatin | 0.66 g |
| | Polyvinyl pyrolidone | 1.54 g |
| | Pentaerythritol | 2.2 g |
| | Water | 50 ml |

CONTROL EXAMPLE 1

The same sample as that of Example 2 was prepared, except that polyvinyl pyrolidone was replaced by gelatin, that is, the binder was composed of all gelatin. When it was exposed to light and was developed by heat, similar to the case of Example 2 a cyan image having a maximum density of merely 0.88 was obtained.

CONTROL EXAMPLE 2

The same solution as that used in Example 3 except that polyvinyl pyrolidone used in the coating liquid of Example 2 was replaced by gelatin; the solution was coated on the sample of Control Example 1, and was dried. When it was exposed to light and was developed by heat similar to the case of Example 2, a cyan image having a maximum density of merely 0.23 was obtained.

As indicated in the above-mentioned Control Examples, it is found that, when using gelatin as the binders, an image having a satisfactory density is not obtainable even in a single layer and a transferred image is hardly obtainable when it is multilayered.

CONTROL EXAMPLE 3

Sample was prepared as same as in Example 3, except that polyvinyl pyrolidone used in Example 3 was replaced by water soluble polyvinyl butyral (Esrex W-201, mfd. by Sekisui Chemical Co., Japan). When it was exposed to light and was developed by heat as in Example 2, a cyan image having a maximum density of 1.58 was obtained, however, the image developed a defect that presented an insular pattern. It was recognized that the cause of this defect was that the gelatin and the water soluble polyvinyl butyral were not compatibly dissolved and the binder created an insular phenomenon by itself. This phenomenon was also found in the case of using polyvinyl alchohol (80,000 in molecular weight and 80% in saponification).

EXAMPLE 4

Samples A, B and C were prepared as in Example 2, except that polyvinyl pyrolidone (40,000 in molecular weight) was replaced by the substances listed below. When they were exposed to light and were developed by heat as in Example 2, the cyan images were obtained as shown in Table 2:

Sample A: Polyvinyl pyrolidone (15000 in molecular weight).

Sample B: Polyvinyl pyrolidone-vinyl acetate copolymer (7:3).

Sample C: Polyvinyl pyrolidone (40,000 in molecular weight) was decreased by 20% and polyvinyl alcohol was added to make up the amount of the decrease of the polyvinyl pyrolidone.

TABLE-2

| Sample | Max. Density | Min. Density |
|---|---|---|
| A | 1.64 | 0.11 |
| B | 1.57 | 0.10 |
| C | 1.69 | 0.12 |

EXAMPLE 5

Samples D, E and F were prepared as in Example 2, except that pentaerythritol, i.e., the thermal solvent, used in Example 2 was replaced by the substances listed below, and Samples G and H wer also prepared similarly, except that the dye donor substances were replaced by Exemplified Compound (8) or (13). When they were exposed to light and were then developed as in Example 2, the results were obtained as shown in Table 3.

TABLE-3

| Sample | Dye Donor Substance | Thermal Solvent | Max. Density | Min. Density | Tone |
|---|---|---|---|---|---|
| D | (3) | Dimethylthiourea | 1.76 | 0.16 | Cyan |
| E | (3) | Polyethylene glycol (2000 in Molecular wt.) | 1.70 | 0.18 | Cyan |
| F | (3) | N,N—dimethylformaldehyde | 1.63 | 0.13 | Cyan |

TABLE-3-continued

| Sample | Dye Donor Substance | Thermal Solvent | Max. Density | Min. Density | Tone |
|---|---|---|---|---|---|
| G | (8) | Pentaerythritol | 1.69 | 0.11 | Magenta |
| H | (13) | Pentaerythritol | 1.57 | 0.09 | Magenta |

EXAMPLE 6

All the surface of the sample of Example 2 was exposed to light of 30,000 CMS. Thus exposed sample was coated by a wire bar with a coating liquid which was the same as that used in Example 2 except that the dye donor substance used in Example 2 was replaced by Exemplified Compound (8), so that the coating could be 65 μm in wet thickness, and it was dried. When it was developed by heat in the same manner as taken in Example 2, only the cyan dyes were transferred to the image receiving element with the density of 1.56, and no magenta dye was transferred at all.

CONTROL EXAMPLE 4

As in Example 6, one sample was prepared by using gelatins only for serving as the binders thereof, and another sample was prepared by using polyvinyl butyral only for the binders. When they were applied with the same process, only a cyan image of 0.22 in the density was obtained in the former sample, and a cyan image of 1.67 in the density as well as a magenta image of 0.85 were transferred in the latter sample. It was consequently found that a color turbidity was caused in the latter when it was multilayered.

EFFECTS OF THE INVENTION

As are apparent from the described Examples, it is recognized that the color diffusion transfer type heat-developable photosensitive elements have the excellent characteristics that they can satisfactorily be developed and they can form or release dyes, and that the dyes having adequate density can be transferred from the lower layer and no color turbidity is caused by an interlayer diffusion of a dye donor substance, even when they are multilayered.

According to this invention, there are incidental effects enjoyable not only on that it is easy to perform a sensitization process such as a chemical or spectral sensitization process of silver halide which is to be used in a photosensitive layer, but also on that it is possible to advantageously manufacture the elements especially in a multilayered coating because the elements are endowed with a setting property, that is, a gelification property in a cool state.

What is claimed is:

1. A dye-diffusion-transfer type, heat-developable color photosensitive element having a support bearing thereon at least two photographic component layers containing a photosensitive silver halide, an organic silver salt, a reducing agent, a diffusible dye donor substance and a binder; said heat-developable color photosensitive element characterized in that said photographic component layer contains a mixture of a gelatin and a vinyl pyrrolidone polymer as the binder thereof and a thermal solvent.

2. A heat-developable color photosensitive element as claimed in claim 1, wherein the vinyl pyrrolidone polymer is of from 1,000 to 400,000 in molecular weight.

3. A heat-developable color photosensitive element as claimed in claim 1, wherein the vinyl pyrrolidone polymer is copolymerized with other monomers to form a copolymer in which at least 20% of the composition is polyvinyl pyrolidone.

4. A heat-developable color photosensitive element as claimed in claim 3, wherein the vinyl pyrrolidone copolymer is of 5,000 to 400,000 in molecular weight.

5. A heat-developable color photosensitive element as claimed in claim 1, wherein the binder comprises gelatin and the vinyl pyrrolidone polymer which are in the proportion of 20~60% to 10~80%.

6. A heat-developable color photosensitive element as claimed in claim 1, wherein the binder is a mixture of gelatin, polyvinyl pyrrolidone of 1,000 to 400,000 in molecular weight, and one or more kinds of other macromolecular substances.

7. A heat-developable color photosensitive element as claimed in claim 1, wherein the binder is a mixture of gelatin, a vinyl pyrrolidone copolymer of 5,000 to 400,000 in molecular weight and one or more kinds of other macromolecular substances.

8. A heat-developable color photosensitive element as claimed in claim 6, wherein the macromolecular substances which are to be mixed into the gelatin and the polyvinyl pyrrolidone or the vinyl pyrrolidone copolymer are contained in the proportion of 0~70% of all the mixture.

9. A heat-developable color photosensitive element as claimed in claim 1, wherein the quantity of the binder used is 0.01~40 g per sq. meter of the support.

10. A heat-developable color photosensitive element as claimed in claim 1, wherein the binder is used in every component layer.

11. A heat-developable color photosensitive element as claimed in claim 1, wherein the thermal solvent is a solid, semisolid or liquid substance at room temperature, and is dissolved or melted in the binder by heating.

12. A heat-developable color photosensitive element as claimed in claim 11, wherein the thermal solvent is an urea derivative, an amide derivative, a polyethylene glycol, or a polyhydric alcohol.

13. A heat-developable color photosensitive element as claimed in claim 12, wherein the urea derivative which serves as the thermal solvent is a compound having the following Formula (1):

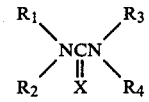

(1)

wherein, X is an oxygen atom or a sulphur atom; $R_1$, $R_2$, $R_3$ and $R_4$ each are a hydrogen atom, a substituted or non-substituted alkyl radical having not more than 12 carbon atoms, in which a ring may be formed by coupling $R_1$ to $R_2$ or $R_3$ to $R_4$; or a substituted or non-substituted aryl radical having not more than 12 carbon atoms, respectively, and they are either the same or the different from each other.

14. A heat-developable color photosensitive element as claimed in claim 12, wherein the amide derivative which serves as the thermal solvent is a compound having the following Formula (2):

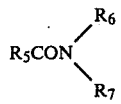

(2)

wherein $R_5$ is a substituted or non-substituted alkyl radical having not more than 12 carbon atoms or a substituted or non-substituted aryl radical having not more than 12 carbon atoms; $R_6$ and $R_7$ may be the same with or different from each other and represent respectively a hydrogen atom, a substituted or non-substituted alkyl radical having not more than 6 carbon atoms, a substituted or non-substituted aryl radical having not more than 12 carbon atoms or an acyl radical having not more than 6 carbon atoms; and $R_5$ and $R_6$ may be coupled to each other to form a ring.

15. A heat-developable color photosensitive element as claimed in claim 12, wherein the polyethylene glycol which serves as the thermal solvent is a compound of 150~10,000 in molecular weight.

16. A heat-developable color photosensitive element as claimed in claim 12, wherein the polyhydric alcohol which serves as the thermal solvent is a ring or chained alcohol having not more than 12 carbon atoms in total and 2 to 6 hydroxy radicals, and which may be substituted by a halogen atom, an alkoxy radical, an acyl radical, or the like.

17. A heat-developable color photosensitive element as claimed in claim 1, wherein the contents of the thermal solvent is 30% to 300% of the quantity of the binder.

18. A heat-developable color photosensitive element as claimed in claim 1, wherein the grain size of the photosensitive silver halide is 0.5 μm to 0.01 μm in diameter.

19. A heat-developable color photosensitive element as claimed in claim 1, wherein the photosensitive silver halide is chemically, spectrally or otherwise sensitizied in a solution of the gelatin and is then mixed with the vinyl pyrrolidone polymer.

20. A heat-developable color photosensitive element as claimed in claim 19, wherein a photosensitive silver halide emulsion which was prepared by chemically, spectrally or otherwise sensitizing in the gelatin solution and then by mixing with the vinyl pyrrolidone polymer, said photosensitive silver halide emulsion is applied to a heat-developable photosensitive layer that is a component layer of the element.

21. A heat-developable color photosensitive element as claimed in claim 1, wherein the quantity of the photosensitive silver halide and a photosensitive silver salt forming component both used in combination is 0.01 to 1.0 mol per mol of an organic silver salt.

22. A heat-developable color photosensitive element as claimed in claim 1, wherein the quantity of a sensitizing dye added is $1\times10^{-4}$ mol to $1\times10^{-1}$ mol per mole of the photosensitive silver halide or a photosensitive silver halide forming component.

23. A heat-developable color photosensitive element as claimed in claim 1, wherein the organic silver salt is a silver salt of benztriazole.

24. A heat-developable color photosensitive element as claimed in claim 23, wherein the organic silver salt is a nitrobenztriazole having the following Formula (3):

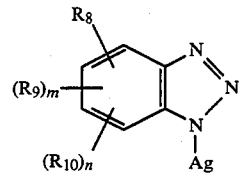

(3)

wherein, $R_8$ represents a nitro group; $R_9$ and $R_{10}$ may be the same with or the different from each other and represent respectively a halogen atom, a hydroxy group, a sulfo group or the salt thereof, a carboxy group or the salt thereof, a nitro group, a cyano group or a carbamoyl group, a sulfamoyl group, an alkyl group, an alkoxy group, an aryl group or an amino group each of which may have a substituent; m is an integer of 0~2; and n is an integer of 0~1; and a benztriazole having the following Formula (4):

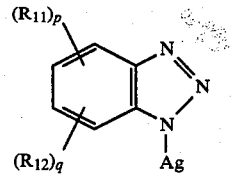

(4)

wherein, $R_{11}$ represents a hydroxy group, a sulfo group or the salt thereof, a carboxy group or the salt thereof, a carbamoyl group which is allowed to have a substituent, or a sulfamoyl group which is allowed to have a substituent; $R_{12}$ represents a halogen atom, a hydroxy group, a sulfo group, or the salt thereof, a carboxy group or the salt thereof, a nitro group, a cyano group, or, an alkyl group, an aryl group, an alkoxy group, or an amino group each of which may have a sustituent; p is an integer of 1 or 2; and q is an integer 0~2.

25. A heat-developable color photosensitive element as claimed in claim 1, wherein the quantity of the organic silver salt used is 0.2 g to 2.0 g per sq. meter of the support.

26. A heat-developable color photosensitive element as claimed in claim 1, wherein the quantity of the reducing agent used is 0.1 mol to 3.0 mol per mol of the organic silver salt.

27. A heat-developable color photosensitive element as claimed in claim 1, wherein the dye donor substance is a compound represented by the following formula (5):

A–B (5)

wherein A represents a coupler residue having a hydrophobic group and B represents a group, which has a water-soluble group, eliminable from the coupler group during the coupling reaction.

28. A heat-developable color photosensitive element as claimed in claim 27, wherein A in the formula (5) is a coupler residue selected from the group consisting of the following formulae (6) to (11):

(6)

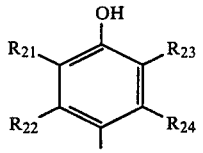

(7)

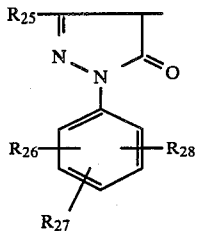

(8)

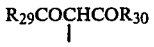

(9)

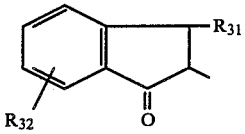

(10)

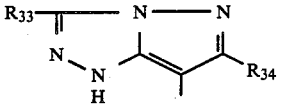

(11)

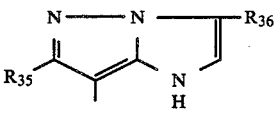

wherein $R_{21}$, $R_{22}$, $R_{23}$ and $R_{24}$ each represent a hydrogen atom, a halogen atom, an alkyl group, an aryl group, an acyl group, an alkyloxycarbonyl group, an aryloxycarbonyl group, an alkylsulfonyl group, an arylsulfonyl group, a carbamoyl group, an acylamino group, an alkoxy group, a sulfamoyl group, a sulfonylamino group or a hydroxyl group, or $R_{21}$ and $R_{22}$ may be bonded together to form a 5- to 6-membered ring; $R_{25}$ represents an alkyl group, an alkoxy group, an arylamino group, an alkylamide group, an arylamide group; $R_{26}$, $R_{27}$ and $R_{28}$ represent a hydrogen atom, a halogen atom, an alkyl group, an alkylamide group, an arylamide group; $R_{29}$ represents an alkyl group, an aryl group; $R_{30}$ represents an arylamino group; $R_{31}$, $R_{32}$, $R_{33}$, $R_{34}$, $R_{35}$ and $R_{36}$ represent the same groups as represented b $R_{21}$ and $R_{22}$ as described above.

29. A heat-developable color photosensitive element as claimed in claim 1, wherein B in the formula (I) is a sulfo group, a carboxyl group, a sulfamoyl group, a sulfino group, a sulfeno group, a thiosulfo group, a dithiosulfo group, a hydroxy sulfonyloxy group, a hydroxy sulfonylthio group, a thiocarboxy group, a carboxyimidic acid group, a hydrazonic acid group, a carbohydrazonic acid group, a hydroximic acid group, a carbohydroximic acid group, a hydroxamic acid group, a carbohydroxamic acid group, a sulfinimidic acid group, a sulfonimidic acid group, a sulfinohydrazonic acid group, a sulfonohydrazonic acid group, a sulfonohydroximic acid group, and a sulfonohydraximic acid group or a group represented by —J—Y wherein J represents a divalent linking group selected from the group consisting of —O—, —S—, $$-\underset{\underset{O}{\|}}{OCO}-,\ -\underset{\underset{O}{\|}}{OC}-NH-,\ -\underset{\underset{O}{\|}}{OC}-,$$

—N=N—, —NHCO—, —$NHSO_2$— and —O—$SO_2$—; and Y represents an alkyl group or aryl group each having a water-soluble group.

* * * * *